US005511628A

United States Patent [19]

Holte

[11] Patent Number: 5,511,628

[45] Date of Patent: Apr. 30, 1996

[54] PNEUMATIC DRILL WITH CENTRAL EVACUATION OUTLET

[76] Inventor: Ardis L. Holte, 181 Polk St., Eugene, Oreg. 97402

[21] Appl. No.: 375,785

[22] Filed: Jan. 20, 1995

[51] Int. Cl.[6] ..... E21B 4/14

[52] U.S. Cl. ..... 175/296; 175/317

[58] Field of Search ..... 175/293, 296, 175/297, 317; 173/63, 62

[56] References Cited

U.S. PATENT DOCUMENTS

| | | | |
|---|---|---|---|
| 3,030,121 | 4/1962 | Scott | 279/97 |
| 4,007,798 | 2/1977 | Gazda | 175/297 |
| 4,174,848 | 11/1979 | Richardson | 279/19 |
| 4,202,557 | 5/1980 | Haussmann et al. | 279/19 |
| 4,512,692 | 4/1985 | Nielsen | 408/226 |
| 4,726,429 | 2/1988 | Kennedy | 173/62 |
| 4,928,775 | 5/1990 | Lee | 175/296 X |
| 5,085,284 | 2/1992 | Fu | 175/296 |
| 5,207,283 | 5/1993 | Lay | 175/296 |
| 5,301,761 | 4/1994 | Fu et al. | 175/296 |
| 5,407,021 | 4/1995 | Kane et al. | 175/296 |

*Primary Examiner*—Frank S. Tsay
*Attorney, Agent, or Firm*—James D. Givnan, Jr.

[57] ABSTRACT

A drill bit is mounted for percussive reciprocal movement in the lower end segment of a drill wear tube. A barrel is in the wear tube and defines a first and second series of exhaust ports. Channels in the barrel communicate the exhaust ports with discharge openings spaced about the head of the drill bit. An inlet opening in the face of the drill bit receives airborne earthen particles carried to an evacuation tube. Keys and keyways are disposed about the drill bit in parallel with the drill bit axis permitting a passageway of optimum size. Disposed within the barrel is a tubular piston which reciprocates in response to pressurized air alternately directed to the piston ends. The piston ends open and close the barrel exhaust ports. Internal surfaces of the piston cooperate with surfaces on the evacuation tube and on a press fitted sleeve thereon to direct compressed air to the piston ends.

5 Claims, 2 Drawing Sheets

PNEUMATIC DRILL WITH CENTRAL EVACUATION OUTLET

Background of the Invention

The present invention pertains generally to pneumatic drills wherein compressed air reciprocates a piston acting on a drill bit with drill exhaust air carrying debris outwardly away from the bore being formed.

Fractured earthen material are taken by the drilling of an exploratory bore which are then evaluated to determine a subterranean profile.

Currently used pneumatic drills for this purpose are approximately 3 or 4 inches in diameter and are susceptible to plugging by fragments of earthen material dislodged by the drill bit. Down time of drilling equipment and lost man hours render the clearing of a drill a costly effort. As drill diameters are quite small, such plugging is not uncommon. The restricted exhaust or evacuation tube diameter found in conventional drills or hammers results, to a large extent, from a small bit diameter enabling acceptable drill penetration speed.

Known drill bit mounting arrangements are not conducive to a bit having a relatively large central bore through which sizeable rock and ore fragments may pass without likelihood of blocking the exhaust passage.

U.S. Pat. Nos. 4,512,692; 4,202,557; 4,174,848 and 3,030,121 all show drill shafts or bits of solid construction and held in a holder by a laterally projecting key or drive members but fail to disclose multiple keys spaced from a drill bit bore of a diameter conducive to unobstructed passage of earthen particles to facilitate the rapid taking of samples at different depths.

SUMMARY OF THE PRESENT INVENTION

The present invention is embodied in a percussion hammer or drill having a relatively large diameter, evacuation tube and drill bit passage.

A drill bit retainer arrangement utilizes keys carried in a bit retainer receiving barrel slotted for key reception. Each key extends radially inward into a keyway formed in the shank or neck of the drill bit. Intrusion of the keys into the drill bit shank is minimal and permits the evacuation bore of the bit to occupy a significant cross sectional portion of the drill bit shank.

A piston of the present drill is driven by compressed air. Out-let ports spaced along the barrel of the drill permit reciprocation of the piston to impart blows to the drill bit. The barrel, in addition to the ports formed therein, defines lengthwise directed channels which receive port exhausted air after each piston storke. Such air is discharged at the forward end of the barrel and through grooves in the bit end. Air exhausted from an annular chamber, in which a tubular piston reciprocates, moves along said channels for discharge past the end of the bit where dislodged debris is entrained in the airflow for axial discharge through a drill bit bore and an evacuation tube.

A series of circumferentially spaced, lengthwise oriented keys confine the drill bit for reciprocation in a compressed airflow. Such key disposition, i.e., spaced about the drill bit, permits the drill bit bore to be of a size to permit exhausting of earthen fragments of large size relative drill bit diameter to minimize plugging of the bit bore.

The present arrangement of keys and keyways permits the evacuation tube to be of a relatively large cross sectional area to greatly reduce jamming of the tube by dislodged earthen fragments.

Important objectives of the present drill include the provision of a drill bit with a grooved shank receiving a plurality of keys with key slots, keyways and keys all oriented lengthwise of the drill bit shank and hence permitting an evacuation conduit of large diameter relative the outer diameter of the present tool; the provision of a percussion type drill having a piston which, in addition to impacting a drill bit, regulates the discharge of air exhausted from a piston chamber through ports in a barrel component provided with lengthwise channels for delivery of the exhausted air to passageways spaced about the perimeter of the head of the drill bit for evacuation of earthen fragments.

DETAILED DESCRIPTION OF THE PREFERRED EMBODIMENTS

Figure 1:
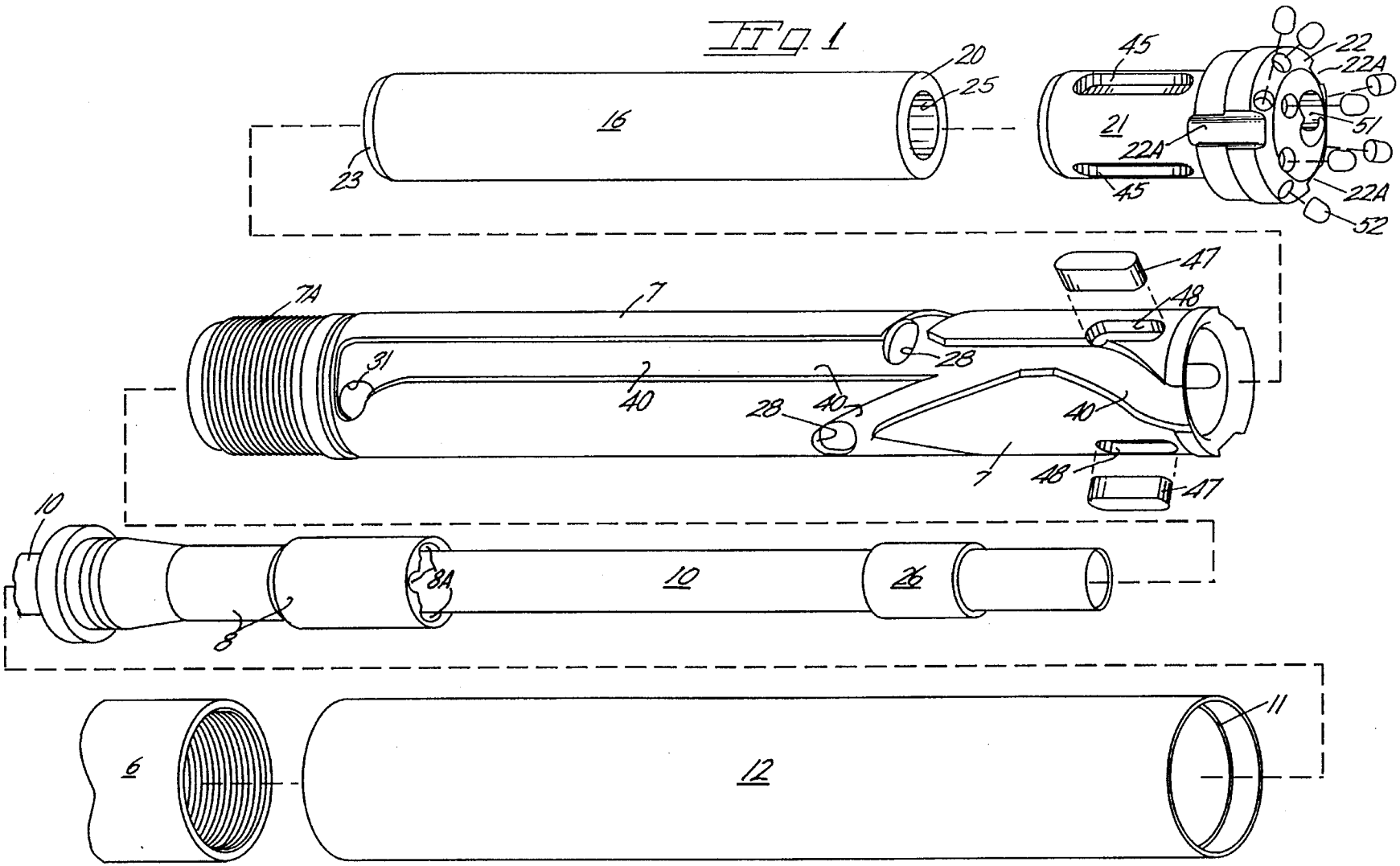
FIG. 1 is an exploded perspective view of the present drill.

With continuing attention to the drawings wherein applied reference numerals indicate parts similarly hereinafter identified, the reference numeral 1 indicates the end segment of a drill pipe attached at its unseen end to a series of drill pipes. The following description is with the drill operatively disposed in an upright position.

An internally threaded sleeve or connector 6 couples drill pipe end 1 to a barrel 7 externally threaded at 7A at its upper end for connector engagement. Barrel 7 is provided at its lower end with a perimetrical lip 9 which abuts an annular shoulder 11 formed adjacent the lower end of an outer or wear tube 12. Tube 12, at its remaining end, abuts connector 6 and accordingly wear tube 12 is confined against axial movement.

An axially disposed debris discharge tube is at 10. A sleeve 8 is press fitted about tube 10. Multiple, lengthwise extending passage-ways at 8A in sleeve 8 carry compressed air discharged from an annular area 1A in the drill pipe. Debris discharge tube 10 is insertably received in enlarged end 15A of a discharge tube segment 15 carried in drill pipe 1.

Figures 2, 3, 4, 5:
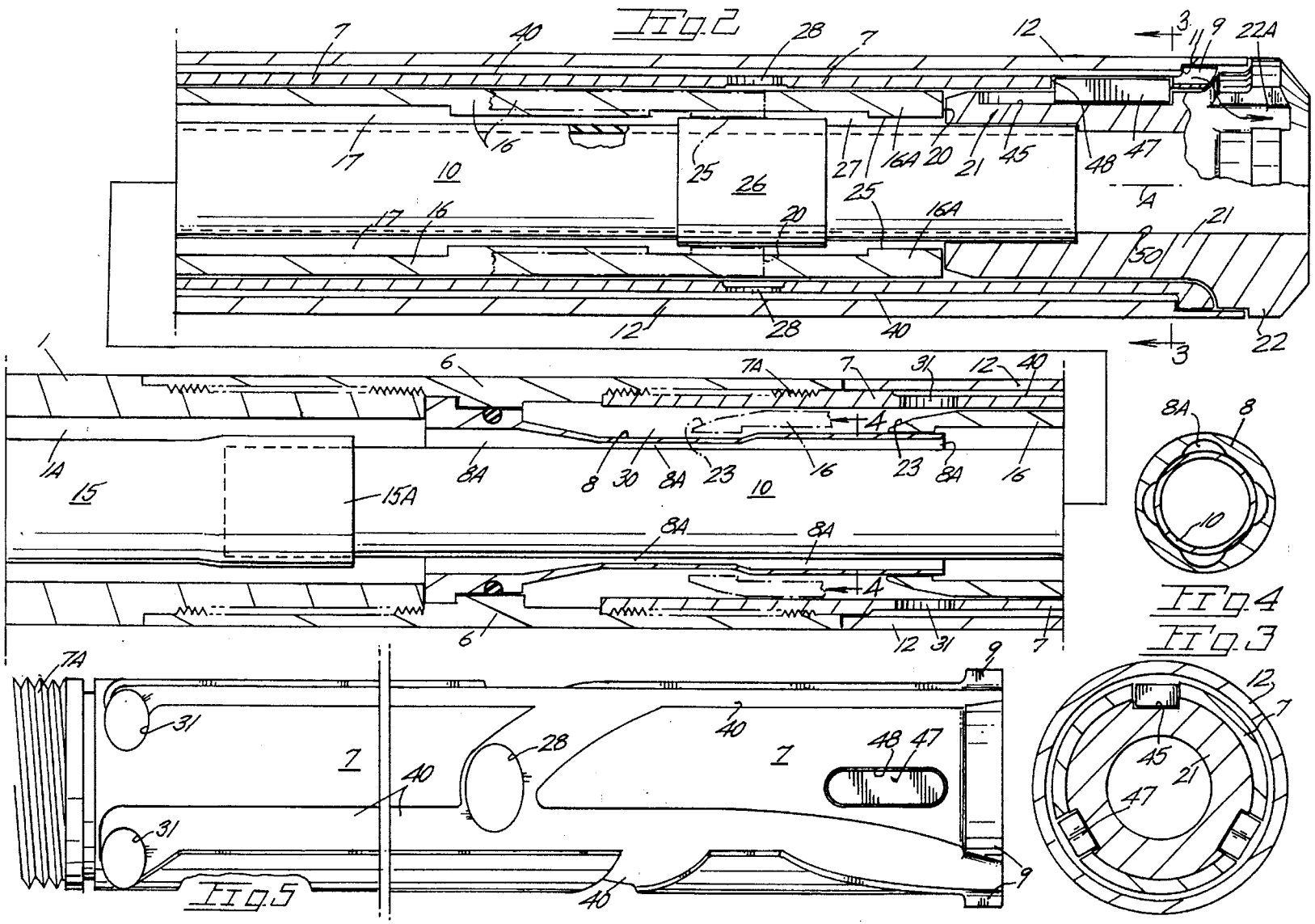
FIG. 2 is a longitudinal sectional view of the present drill.
FIGS. 3 and 4 are vertical cross sectional views taken through lines 3—3 and 4—4 of FIG. 2.
FIG. 5 is a side elevational view of the barrel component of the present drill.

Slidably mounted in barrel 7 is a tubular piston 16 which reciprocates in a space 17 inwardly defined by discharge tube 10 along with press fitted sleeve 8 thereon and outwardly defined by the inner wall surface of the barrel 7. The lower end 20 of the piston impacts the end of a drill bit shank 21. Piston 16 is in a sliding fit with the inner wall surface of barrel 7 and at its lower end 16A cooperates with a collar 26, fixed on discharge tube 10, to open and close a chamber 27. A pressurized air flow is alternately directed to piston lower end 20 and to a piston upper end at 23. A piston inner wall surface at 25 cooperates with collar 26 fixed in place on debris discharge tube 10 to define pressurized chamber 27 charged by air delivered to the interior of the piston by passageways 8A in press fitted sleeve 8. Chamber 27 is initially pressurized to cause displacement of the piston upwardly away from drill bit shank 21 until piston end 20 reaches the broken line position of FIG. 2, whereat an exhaust port 28, of a first series of exhaust ports, is opened to vent pressurized air from chamber 27. Coincident with piston lower end 20 opening the series of ports 28 is the upward displacement of piston upper end 23 past the end of sleeve 8 to permit a pressurized, reverse airflow to pass along the outer wall of sleeve 8 and into chamber 30 to pressurize same and impart a downward force on piston end 23. Downward piston travel occurs until piston end 23 opens an exhaust port 31 of a second series of exhaust ports formed in barrel 7. Opening of ports 31 by the piston exhausts pressurized air from chamber 30. Accordingly piston 16, in addition to percussive action on drill bit 21, serves to open and close the two series of ports 28 and 31 to provide valve means for exhausting air from chambers 27 and 30. Both series of exhaust ports 28 and 31 are in downstream open communication with multiple channels 40 formed lengthwise in the outer wall of barrel 7. With attention to Figure 5, it will be seen that channels 40 communicate the series of ports 28 and 31 with discharge openings 22A in drill bit head 22.

Drill bit shank 21 defines axially directed keyways 45, each of which receives a lengthwise oriented key 47. Barrel 7 defines key slots 48 in which the keys 47 are carried. The keys have their major axis disposed parallel to the lengthwise axis A of drill bit 21 and permit the drill bit shank to define a passageway 50 for removal of airborne earthen fragments loosened by hardened tips at 52 in a drill bit head 22 picked up by air flows discharged via openings 22A in the drill bit. For particle evacuation the frontal face of the drill bit defines an inlet opening 51. Such disposition of keys 47 in radially spaced, parallel relationship to bit axis permits passageway 50 to be of a diameter to permit passage of relatively large earthen fragments without risk of jamming the passageway.

While I have shown but one embodiment of the invention, it will be apparent to those skilled in the art that the invention may be embodied still otherwise without departing from the spirit and scope of the invention.

Having thus described the invention, what is claimed and desired to be secured by a Letters Patent is:

1. A pneumatic percussion drill for attachment to a length of drill pipe and including:

a wear tube;

a barrel housed within said wear tube and defining a first and a second series of exhaust ports and also exhaust channels extending therealong;

a piston slidably carried in said barrel, said piston opening and closing said ports;

a debris discharge tube axially disposed in said piston for coupling to said drill pipe;

a drill bit slidably carried in said barrel adjacent a barrel end and having a head defining an inlet opening for earthen debris, said head defining air outlets each in receiving communication with one of said exhaust channels for the discharge of compressed air into a ground bore formed by the bit head, said drill bit having a shank defining an axial bore in receiving communication through said inlet opening with the ground bore being formed to receive airborne earthen fragments for discharge into said debris discharge tube; and key means limiting drill bit travel including a series of elongate keys in parallel with the axial bore of the drill bit, keyways and key slots in said drill bit and said barrel.

2. The drill claimed in claim 1 wherein said drill bit has an outer perimeter, said air outlets are spaced about the outer perimeter of said bit head, said inlet opening defined by a frontal face of the bit head.

3. The drill claimed in claim 1 wherein said channels are partially defined by said wear tube.

4. The drill claimed in claim 1 wherein said wear tube is circumposed about said keys and confines the keys against radial displacement.

5. In an improved pneumatic percussion drill having a barrel and an elongate drill bit having a shank and an axial passageway with said shank slidably carried by said barrel, the improvement comprising lengthwise disposed keyways defined by and spaced about the drill bit shank, key slots defined by and spaced about said barrel, elongate keys in said keyways and said key slots, said keys in parallel with the major axis of said drill bit and of lesser length than said keyways to permit reciprocal travel of the drill bit.

* * * * *